US008480916B2

(12) United States Patent
Fernando et al.

(10) Patent No.: US 8,480,916 B2
(45) Date of Patent: Jul. 9, 2013

(54) ULTRA LOW WEIGHT INSULATION BOARD

(75) Inventors: Joseph A. Fernando, Amherst, NY (US); Robert Rioux, Amherst, NY (US)

(73) Assignee: Unifrax I LLC, Niagara Falls, NY (US)

( * ) Notice: Subject to any disclaimer, the term of this patent is extended or adjusted under 35 U.S.C. 154(b) by 0 days.

(21) Appl. No.: 12/894,832

(22) Filed: Sep. 30, 2010

(65) Prior Publication Data

US 2011/0079746 A1 Apr. 7, 2011

Related U.S. Application Data

(60) Provisional application No. 61/248,198, filed on Oct. 2, 2009.

(51) Int. Cl.
*E04B 1/74* (2006.01)

(52) U.S. Cl.
USPC ..... 252/62

(58) Field of Classification Search
USPC . 252/62; 501/37, 95.1, 95.2, 35, 36; 428/161; 523/178; 524/442, 444, 49, 494, 495
See application file for complete search history.

(56) References Cited

U.S. PATENT DOCUMENTS

| | | | | |
|---|---|---|---|---|
| 2,624,658 | A | 1/1953 | Parker et al. | |
| 3,353,975 | A | 11/1967 | Shannon et al. | |
| 3,379,608 | A | 4/1968 | Roberts et al. | |
| 3,418,403 | A | 12/1968 | Garnero | |
| 3,458,329 | A | 7/1969 | Owens et al. | |
| 3,515,624 | A | 6/1970 | Garnero | |
| 3,779,861 | A | 12/1973 | Jones | |
| 3,908,062 | A | 9/1975 | Roberts | |
| 3,933,513 | A * | 1/1976 | Mellows | 501/129 |

(Continued)

FOREIGN PATENT DOCUMENTS

| | | |
|---|---|---|
| DE | 20 2005 021 073 U1 | 3/2007 |
| EP | 0973697 | 7/2000 |
| EP | 1 094 164 A1 | 4/2001 |
| GB | 1383305 A | 2/1975 |

OTHER PUBLICATIONS

Biosoluble mineral wool—BER Deckensystem Gmbh (product listing) http://www.ber-densystem.de/en/glossary/biosoluble-mineral-wool.html.*

(Continued)

*Primary Examiner* — Emily Le
*Assistant Examiner* — Lynne Edmondson
(74) *Attorney, Agent, or Firm* — Curatolo Sidoti Co., LPA; Joseph G. Curatolo; Salvatore A. Sidoti

(57) ABSTRACT

Provided is a lightweight, fibrous thermal insulation panel including high temperature resistant biosoluble inorganic fibers, expanded perlite, binder, and optionally conventional high temperature resistant inorganic fibers. Further provided is a method for preparing a lightweight, fibrous high temperature thermal insulation panel including: (a) providing an aqueous slurry comprising from about 15% to about 90% high temperature resistant biosoluble inorganic fibers, from about 10% to about 80% expanded perlite, at least one of from 0% to about 50% organic binder or from 0% to about 20% inorganic binder by weight, and optionally from 0% to about 70% conventional high temperature resistant fibers; (b) forming the lightweight, fibrous thermal insulation panel by depositing the said aqueous slurry onto a substrate; (c) partially dewatering the slurry on the substrate to form a fibrous layer; and (d) drying the fibrous layer to a moisture content of no greater than about 5% by weight.

36 Claims, 3 Drawing Sheets

U.S. PATENT DOCUMENTS

| | | | | | |
|---|---|---|---|---|---|
| 3,952,830 | A | | 4/1976 | Oshida et al. | |
| 4,024,014 | A | | 5/1977 | Akerson | |
| 4,118,273 | A | | 10/1978 | Godin et al. | |
| 4,126,512 | A | | 11/1978 | Hill | |
| 4,201,606 | A | * | 5/1980 | Neat | 149/37 |
| 4,363,199 | A | | 12/1982 | Kucheria et al. | |
| 4,435,468 | A | | 3/1984 | Ten Eyck | |
| 4,489,121 | A | | 12/1984 | Luckanuck | |
| 4,572,857 | A | | 2/1986 | Bekaert | |
| 4,612,087 | A | | 9/1986 | Ten Eyck | |
| 4,904,510 | A | | 2/1990 | Nath et al. | |
| 4,911,788 | A | * | 3/1990 | Pittman et al. | 162/145 |
| 5,134,179 | A | | 7/1992 | Felegi, Jr. et al. | |
| 5,215,806 | A | | 6/1993 | Bailey | |
| 5,250,153 | A | * | 10/1993 | Izard et al. | 162/152 |
| 5,273,821 | A | | 12/1993 | Olson et al. | |
| 5,290,350 | A | * | 3/1994 | Besnard et al. | 106/205.01 |
| 5,332,699 | A | | 7/1994 | Olds et al. | |
| 5,569,629 | A | | 10/1996 | Ten Eyck et al. | |
| 5,585,312 | A | | 12/1996 | Ten Eyck et al. | |
| 5,714,421 | A | | 2/1998 | Olds et al. | |
| 5,811,360 | A | | 9/1998 | Jubb | |
| 5,821,183 | A | | 10/1998 | Jubb | |
| 5,874,375 | A | | 2/1999 | Zoitos et al. | |
| 5,911,818 | A | * | 6/1999 | Baig | 106/698 |
| 5,928,975 | A | | 7/1999 | Jubb | |
| 5,955,398 | A | | 9/1999 | Fisher et al. | |
| 6,025,288 | A | | 2/2000 | Zoitos et al. | |
| 6,030,910 | A | | 2/2000 | Zoitos et al. | |
| 6,149,831 | A | | 11/2000 | DePorter et al. | |
| 6,153,674 | A | * | 11/2000 | Landin | 524/35 |
| 6,468,932 | B1 | | 10/2002 | Robin et al. | |
| 6,551,951 | B1 | | 4/2003 | Fay et al. | |
| 6,855,298 | B2 | | 2/2005 | Ten Eyck | |
| 6,861,381 | B1 | | 3/2005 | Jubb et al. | |
| 6,953,757 | B2 | | 10/2005 | Zoitos et al. | |
| 7,153,796 | B2 | | 12/2006 | Jubb et al. | |
| 7,259,118 | B2 | | 8/2007 | Jubb et al. | |
| 7,410,688 | B2 | | 8/2008 | Baig | |
| 7,413,797 | B2 | | 8/2008 | De Souza | |
| 2002/0017222 | A1 | | 2/2002 | Luongo | |
| 2003/0060113 | A1 | * | 3/2003 | Christie et al. | 442/364 |
| 2004/0234436 | A1 | | 11/2004 | Howorth | |
| 2006/0078720 | A1 | * | 4/2006 | Toas et al. | 428/292.1 |
| 2008/0166937 | A1 | | 7/2008 | Garvey | |
| 2008/0206114 | A1 | * | 8/2008 | Hornback | 422/177 |
| 2009/0056898 | A1 | * | 3/2009 | Wiker et al. | 162/218 |
| 2009/0060802 | A1 | | 3/2009 | Beauharnois | |

OTHER PUBLICATIONS

International Search Report, Form PCT/ISA/210, mailed Oct. 18, 2012, for corresponding PCT International Patent Application No. PCT/US2010/002654.

Written Opinion, Form PCT/ISA/237, mailed Oct. 18, 2012, for corresponding PCT International Patent Application No. PCT/US2010/002654.

International Preliminary Report on Patentability, Form PCT/IB/373 for PCT International Patent Application No. PCT/US2010/002654, mailing date Oct. 23, 2012.

* cited by examiner

ULTRA LOW WEIGHT INSULATION BOARD

This application claims the benefit of the filing date, under 35 U.S.C. §119(e), of U.S. Provisional Application for Patent Ser. No. 61/248,198, filed on Oct. 2, 2009.

A lightweight, fibrous thermal insulation panel is provided for use in a variety of industries including the transportation, aviation, shipping and construction industries, for the manufacture of vehicle bodies, walls, and flooring, cabin panels and partitions, and the like.

In certain embodiments, a lightweight, fibrous thermal insulation panel is provided for use in fire protection applications where substantial weight savings and minimizing add-on weight is important, particularly in the marine, aviation/aerospace and land/rail transport industries, where government and transportation industry regulations mandate compliance with fire resistance and non-combustibility standards. For instance, lightweight insulating materials that have a high thermal resistivity and high flame resistance are suitable for fire-protective panels and components of vehicular interiors such as cabins and cargo holds, partitions, fire doors, or the like, or for transporting combustible materials.

In the transportation industry, the material must meet combustibility and fire resistance ratings of the Federal Transportation Administration (FTA) and comply with FTA standards based upon ASTM E162, ASTM 662 or ASTM E119 tests, in order to delay the spread of a fire, limit heat transfer, and minimize smoke generation at the time of a fire.

In the aviation/aerospace industry, the material must comply, among others, with the 15 minute fireproof or 5 minute fire resistant test based upon Federal Aviation Administration regulation AC 20-135. Thus, a need exists for thermal insulation panels that are thin, lightweight, high temperature resistant, and non-combustible.

In marine applications, governmental agencies require properly rated firewalls, fire protection structural insulation and fireproof panels for bulkheads, decks, and overheads in fire zones and other ship compartments for protection against fire. Under the United States Coast Guard regulations, fireproofing means the structure must be able to withstand exposure to heat and flames and withstand exposure to temperatures of up to about 1700° F. (927° C.) for up to 60 minutes, depending upon the location of the bulkhead. The standards required by the U.S. Coast Guard and the International Maritime Organization are found in IMO Resolution A.754(18).

Typically, bulkheads and overheads of a ship are fire protected by using insulation blankets or insulation panels that are fastened to the sides of the bulkhead after the bulkhead is installed. These blankets or panels are impractical or suffer from reduced performance for a variety of reasons, such as heavy weight, thickness, durability, and the requirement for a coating or surface finishing which adds a flammable top layer and significant additional expense. Spray-on fireproof coatings are more difficult and time-consuming to apply and inspect, and must be replaced or repaired frequently due to cracking and peeling. This increases the installation and maintenance costs and involves downtime for the craft.

There is a need for thermal insulation panels that are thin, lightweight, high temperature resistant, and non-combustible, that comply with the SOLAS (Safety of Life at Sea) A60 requirements of the IMO (International Maritime Organization), IMO FTP Code fire test requirements detailed in the FTP Code Book and per IMO Res.A.754(18), Fire Resisting Division for High Speed Craft (HSC A60), B0 and N30 fire resistance ratings, ASTM E162, ASTM 662 and ASTM E119 tests, and/or Federal Aviation Administration regulation AC 20-135, are water resistant, easy to install, require no additional top coat, installation of blankets or any other type of fireproofing materials, are inexpensive compared to typical fire protective panels in use today, have low organic and binder content, and are non-toxic and environmentally safe.

Figure 1:
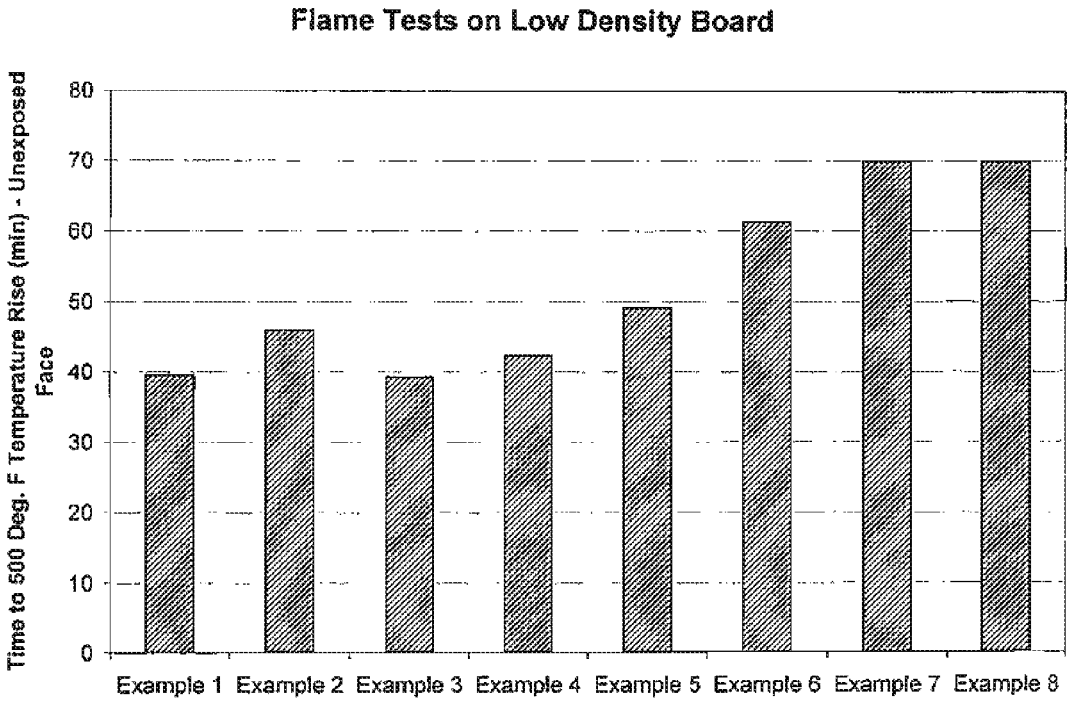
FIG. 1 is a graph depicting the results of flame tests for eight specimens tested in accordance with the time temperature heating curve of the FTP Code (1998) Resolution A.754 (18).

Provided is a lightweight, fibrous high temperature thermal insulation panel comprising high temperature resistant biosoluble inorganic fibers, expanded perlite, organic and/or inorganic binder, and optionally conventional high temperature resistant inorganic fibers. The phrase "high temperature thermal insulation", when used herein to refer to the lightweight, fibrous thermal insulation panel, means that the thermal insulation panel is capable of withstanding temperatures of from about 600° C. to about 1200° C.

According to certain embodiments, the lightweight, fibrous high temperature thermal insulation panel comprises, by weight, from about 15% to about 90% high temperature resistant biosoluble inorganic fibers, from about 10% to about 80% perlite, from 0% to about 50% organic binder, and optionally from 0% to about 70% conventional high temperature resistant inorganic fibers.

According to yet other embodiments, the lightweight, fibrous high temperature thermal insulation panel comprises, by weight, from about 15% to about 90% magnesium silicate fiber, from about 10% to about 80% perlite, from 0% to about 70% mineral wool, and from 0% to about 50% acrylic latex binder.

According to certain embodiments, the lightweight, fibrous high temperature thermal insulation panel is substantially noncombustible, and comprises, by weight, from about 15% to about 90% high temperature resistant biosoluble inorganic fibers, from about 10% to about 80% perlite, optionally from 0% to about 70% conventional high temperature resistant inorganic fibers, and from 0% to about 6% organic binder and/or from 0% to about 20% inorganic binder.

According to one embodiment, the lightweight, fibrous high temperature thermal insulation panel comprises, by weight about 15% magnesium silicate fiber, about 40% mineral wool, about 40% expanded perlite, and about 3.5% acrylic latex.

Also provided is a method for preparing a lightweight, fibrous high temperature thermal insulation panel comprising providing an aqueous slurry comprising high temperature resistant biosoluble inorganic fibers, expanded perlite, organic and/or inorganic binder, and optionally conventional high temperature resistant inorganic fibers, and depositing the aqueous slurry onto a substrate, partially dewatering the slurry on the substrate to form a fibrous layer, and drying the fibrous layer to a moisture content of no greater than about 0.5% by weight.

Further provided is a method for preparing a lightweight, fibrous high temperature thermal insulation panel comprising: (a) providing an aqueous slurry comprising from about 15% to about 90% high temperature resistant biosoluble inorganic fibers, from about 10% to about 80% expanded perlite, binder comprising at least one of from 0% to about 50% organic binder or from 0% to about 20% inorganic binder by weight, and optionally from 0% to about 70% conventional high temperature resistant fibers; (b) forming the lightweight, fibrous thermal insulation panel by depositing the said aqueous slurry onto a substrate; (c) partially dewatering the slurry on the substrate to form a fibrous layer; and (d) drying the fibrous layer to a moisture content of no greater than about 5% by weight.

Certain embodiments of the lightweight, fibrous high temperature thermal insulation panel have a fire rating in compliance with International Maritime Organization SOLAS A60, B0 or N30 fire rating and resistance requirements, ASTM E162, ASTM 662, ASTM E119, ASTM D136, ASTM E136, or ISO 1182 tests, or Federal Aviation Administration regulation AC 20-135, all of which are incorporated herein by reference.

Suitable high temperature resistant biosoluble inorganic fibers that may be used to prepare the lightweight, fibrous high temperature thermal insulation panel include, without limitation, biosoluble alkaline earth silicate fibers such as calcia-magnesia-silicate fibers, magnesia-silicate fibers, calcia-aluminate fibers, potassia-calcia-aluminate fibers, potassia-alumina-silicate fibers, or sodia-alumina-silicate fibers.

The term "biosoluble" inorganic fibers refer to inorganic fibers that are soluble or otherwise decomposable in a physiological medium or in a simulated physiological medium, such as simulated lung fluid. The solubility of the fibers may be evaluated by measuring the solubility of the fibers in a simulated physiological medium over time. A method for measuring the biosolubility (i.e., the non-durability) of the fibers in physiological media is disclosed in U.S. Pat. No. 5,874,375 assigned to Unifrax I LLC, which is incorporated herein by reference. Other methods are suitable for evaluating the biosolubility of inorganic fibers. According to certain embodiments, the biosoluble inorganic fibers exhibit a solubility of at least 30 ng/cm$^2$-hr when exposed as a 0.1 g sample to a 0.3 ml/min flow of simulated lung fluid at 37° C. According to other embodiments, the biosoluble inorganic fibers may exhibit a solubility of at least 50 ng/cm$^2$-hr, or at least 100 ng/cm$^2$-hr, or at least 1000 ng/cm$^2$-hr when exposed as a 0.1 g sample to a 0.3 ml/min flow of simulated lung fluid at 37° C.

Without limitation, suitable examples of biosoluble alkaline earth silicate fibers that can be used to prepare a thermal insulation panel include those fibers disclosed in U.S. Pat. Nos. 6,953,757, 6,030,910, 6,025,288, 5,874,375, 5,585,312, 5,332,699, 5,714,421, 7,259,118, 7,153,796, 6,861,381, 5,955,389, 5,928,075, 5,821,183, and 5,811,360, which are incorporated herein by reference.

The high temperature resistant biosoluble alkaline earth silicate fibers are typically amorphous inorganic fibers that may be melt-formed, and may have an average diameter in the range of from about 1 μm to about 10 μm, and in certain embodiments, in the range of from about 2 μm to about 4 μm. While not specifically required, the fibers may be beneficiated, as is well known in the art.

According to certain embodiments, the biosoluble alkaline earth silicate fibers may comprise the fiberization product of a mixture of magnesia and silica. These fibers are commonly referred to as magnesium-silicate fibers. The magnesium-silicate fibers generally comprise the fiberization product of from about 60 to about 90 weight percent silica, from greater than 0 to about 35 weight percent magnesia and about 5 weight percent or less impurities. According to certain embodiments, the alkaline earth silicate fibers comprise the fiberization product of from about 65 to about 86 weight percent silica, from about 14 to about 35 weight percent magnesia, from 0 to about 7 weight percent zirconia and about 5 weight percent or less impurities. According to other embodiments, the alkaline earth silicate fibers comprise the fiberization product of from about 70 to about 86 weight percent silica, from about 14 to about 30 weight percent magnesia, and about 5 weight percent or less impurities. A suitable magnesium-silicate fiber is commercially available from Unifrax I LLC (Niagara Falls, N.Y.) under the registered trademark ISOFRAX®. Commercially available ISOFRAX® fibers generally comprise the fiberization product of from about 70 to about 80 weight percent silica, from about 18 to about 27 weight percent magnesia and about 4 weight percent or less impurities. ISOFRAX® alkaline earth silicate fibers may have an average diameter of from about 1 μm to about 3.5 μm; in some embodiments, from about 2 μm to about 2.5 μm.

According to certain embodiments, the biosoluble alkaline earth silicate fibers may alternatively comprise the fiberization product of a mixture of oxides of calcium, magnesium and silicon. These fibers are commonly referred to as calcia-magnesia-silicate fibers. According to certain embodiments, the calcia-magnesia-silicate fibers comprise the fiberization product of from about 45 to about 90 weight percent silica, from greater than 0 to about 45 weight percent calcia, from greater than 0 to about 35 weight percent magnesia, and about 10 weight percent or less impurities. Useful calcia-magnesia-silicate fibers are commercially available from Unifrax I LLC (Niagara Falls, N.Y.) under the registered trademark INSULFRAX®. INSULFRAX® fibers generally comprise the fiberization product of from about 61 to about 67 weight percent silica, from about 27 to about 33 weight percent calcia, and from about 2 to about 7 weight percent magnesia. Other suitable calcia-magnesia-silicate fibers are commercially available from Thermal Ceramics (Augusta, Ga.) under the trade designations SUPERWOOL® 607, SUPERWOOL® 607 MAX and SUPERWOOL® HT. SUPERWOOL® 607 fibers comprise from about 60 to about 70 weight percent silica, from about 25 to about 35 weight percent calcia, from about 4 to about 7 weight percent magnesia, and trace amounts of alumina. SUPERWOOL® 607 MAX fibers comprise from about 60 to about 70 weight percent silica, from about 16 to about 22 weight percent calcia, from about 12 to about 19 weight percent magnesia, and trace amounts of alumina. SUPERWOOL® HT fiber comprise about 74 weight percent silica, about 24 weight percent calcia and trace amounts of magnesia, alumina and iron oxide.

According to certain embodiments, the conventional high temperature resistant inorganic fibers that may be used to prepare the lightweight, fibrous high temperature thermal insulation panel include, without limitation, refractory ceramic fibers such as alumina-silicate fibers, kaolin fibers, or alumina-zirconia-silica fibers; mineral wool fibers; alumina-magnesia-silica fibers such as S-glass fibers or S2-glass fibers; E-glass fibers; silica fibers; alumina fibers; fiberglass; glass fibers; or mixtures thereof.

Refractory ceramic fiber (RCF) typically comprises alumina and silica. A suitable alumino-silicate ceramic fiber is commercially available from Unifrax I LLC (Niagara Falls, N.Y.) under the registered trademark FIBERFRAX. The FIBERFRAX® ceramic fibers comprise the fiberization product of a melt comprising from about 45 to about 75 weight percent alumina and from about 25 to about 55 weight percent silica. The FIBERFRAX® fibers exhibit operating temperatures of up to about 1540° C. and a melting point up to about 1870° C. In certain embodiments, the alumino-silicate fiber may comprise from about 40 weight percent to about 60 weight percent $Al_2O_3$ and from about 60 weight percent to about 40 weight percent $SiO_2$, and in some embodiments, from about 47 to about 53 weight percent alumina and from about 47 to about 53 weight percent silica.

The RCF fibers are a fiberization product that may be blown or spun from a melt of the component materials. RCF may additionally comprise the fiberization product of alumina, silica and zirconia, in certain embodiments in the amounts of from about 29 to about 31 percent by weight alumina, from about 53 to about 55 percent by weight silica, and from about 15 to about 17 weight percent zirconia. RCF fiber length is in certain embodiments, in the range of from about 3 mm to 6.5 mm, typically less than about 5 mm, and the average fiber diameter range is from about 0.5 μm to about 14 μm.

According to certain embodiments, the mineral wool fibers that may be used to prepare the lightweight, fibrous thermal insulation panel include, without limitation, at least one of rock wool fibers, slag wool fibers, glass wool fibers, or diabasic fibers. Mineral wool fibers may be formed from basalt, industrial smelting slags and the like, and typically comprise silica, calcia, alumina, and/or magnesia. Glass wool fibers are typically made from a fused mixture of sand and recycled glass materials. Mineral wool fibers may have a diameter of from about 1 μm to about 20 μm, in some instances from about 5 μm to about 6 μm.

The high temperature resistant inorganic fibers may comprise an alumina/silica/magnesia fiber, such as S-2 Glass from Owens Corning, Toledo, Ohio. The alumina/silica/magnesia S-2 glass fiber typically comprises from about 64 weight percent to about 66 weight percent $SiO_2$, from about 24 weight percent to about 25 weight percent $Al_2O_3$, and from about 9 weight percent to about 11 weight percent MgO. S2 glass fibers may have an average diameter of from about 5 μm to about 15 μm; in some embodiments, about 9 μm.

The E-glass fiber typically comprises from about 52 weight percent to about 56 weight percent $SiO_2$, from about 16 weight percent to about 25 weight percent CaO, from about 12 weight percent to about 16 weight percent $Al_2O_3$, from about 5 weight percent to about 10 weight percent $B_2O_3$, up to about 5 weight percent MgO, up to about 2 weight percent of sodium oxide and potassium oxide and trace amounts of iron oxide and fluorides, with a typical composition of about 55 weight percent $SiO_2$, about 15 weigh percent $Al_2O_3$, about 7 weight percent $B_2O_3$, about 3 weight percent MgO, about 19 weight percent CaO and traces up to about 0.3 weight percent of the other above mentioned materials.

Examples of suitable silica fibers include those leached glass fibers available from BelChem Fiber Materials GmbH, Germany, under the trademark BELCOTEX® and from Hitco Carbon Composites, Inc. of Gardena, Calif., under the registered trademark REFRASIL®, and from Polotsk-Steklovolokno, Republic of Belarus, under the designation PS-23®. A process for making leached glass silica fibers is contained in U.S. Pat. No. 2,624,658 and in European Patent Application Publication No. 0973697.

Generally, the leached glass silica fibers will have a silica content of at least about 67 percent by weight. In certain embodiments, the silica fibers contain at least about 90 percent by weight, and in certain of these, from about 90 percent by weight to less than about 99 percent by weight silica.

The average fiber diameter of these leached glass silica fibers may be greater than at least about 3.5 μm, and often greater than at least about 5 μm. On average, the silica fibers typically have a diameter of about 9 μm, up to about 14 μm, and are non-respirable.

The BELCOTEX® fibers are standard type, staple fiber pre-yarns. These fibers have an average fineness of about 550 tex and are generally made from silicic acid modified by alumina. The BELCOTEX® fibers are amorphous and generally contain, by weight, about 94.5 percent silica, about 4.5 percent alumina, less than 0.5 percent sodium oxide, and less than 0.5 percent of other components. These fibers have an average fiber diameter of about 9 μm and a melting point in the range of 1500° C. to 1550° C. These fibers are heat resistant to temperatures of up to 1100° C.

The REFRASIL® fibers, like the BELCOTEX® fibers, are amorphous leached glass fibers high in silica content for providing thermal insulation for applications in the 1000° C. to 1100° C. temperature range. These fibers are between about 6 μm and about 13 μm in diameter, and have a melting point of about 1700° C. The fibers, after leaching, typically have a silica content of about 95 percent by weight. Alumina may be present in an amount of about 4 percent by weight with other components being present in an amount of 1 percent or less.

The PS-23® fibers from Polotsk-Steklovolokno are amorphous glass fibers high in silica content and are suitable for thermal insulation for applications requiring resistance to at least about 1000° C. These fibers have a fiber length in the range of about 5 mm to about 20 mm and a fiber diameter of about 9 μm. These fibers, like the REFRASIL® fibers, have a melting point of about 1700° C.

Perlite is a naturally occurring volcanic mineral that typically comprises about 70-75% $SiO_2$, about 12-15% $Al_2O_3$, less than about 5% each $Na_2O$, $K_2O$, MgO and CaO and about 2-5% bound water. Raw perlite is expanded from about 4 to about 20 times its original volume by heating to about 850° C. to 900° C., and may be milled to a particle size from about 10 μm to about 50 μm, or having mesh sizes smaller than 325 mesh, prior to its use in the formulation of the subject lightweight panels, although this is not critical. Typically, after expansion, at least from about 0% to about 31% of the perlite particles are retained by a +70 mesh screen, at least from about 0% to about 51% of the perlite particles are retained by a +140 mesh screen, and at least from about 1% to about 77% of the perlite particles are retained by a +325 mesh screen.

Perlite can be obtained from numerous commercial sources and may be graded by density in kilograms per cubic meter ($kg/m^3$). According to certain embodiments, the perlite that is used to prepare the lightweight, fibrous thermal insulation panel is expanded perlite that has a density of from about 30 $kg/m^3$ to about 150 $kg/m^3$. In certain embodiments, perlite having a density in the range of 55 $kg/m^3$ to 146 $kg/m^3$.

The lightweight, fibrous high temperature thermal insulation panel may further include one or more organic binders. The organic binder(s) may be provided as a solid, a liquid, a solution, a dispersion, a latex, or similar form. Examples of suitable organic binders include, but are not limited to, acrylic latex, (meth)acrylic latex, phenolic resins, copolymers of styrene and butadiene, vinylpyridine, acrylonitrile, copolymers of acrylonitrile and styrene, vinyl chloride, polyurethane, copolymers of vinyl acetate and ethylene, polyamides, silicones, unsaturated polyesters, epoxy resins, polyvinyl esters (such as polyvinylacetate or polyvinylbutyrate latexes) and the like. According to certain embodiments, the lightweight, fibrous thermal insulation panel utilizes an acrylic latex binder.

The organic binder may be included in the thermal insulation panel in an amount of from 0 to about 50 weight percent, in certain embodiments from 0 to about 20 weight percent, and in some embodiments from 0 to about 10 weight percent, based on the total weight of the panel. In embodiments in which the thermal insulation panel is non-combustible, the organic binder may be included in an amount of from 0 to about 6 weight percent.

The panel may include polymeric binder fibers instead of, or in addition to, a resinous or liquid binder. These polymeric binder fibers, if present, may be used in amounts ranging from greater than 0 to about 5 percent by weight, in other embodiments from 0 to about 2 weight percent, based upon 100 percent by weight of the total composition, to aid in binding the fibers together. Suitable examples of binder fibers include polyvinyl alcohol fibers, polyolefin fibers such as polyethylene and polypropylene, acrylic fibers, polyester fibers, ethyl vinyl acetate fibers, nylon fibers and combinations thereof.

Solvents for the binders, if needed, can include water or a suitable organic solvent, such as acetone, for the binder utilized. Solution strength of the binder in the solvent (if used) can be determined by conventional methods based on the binder loading desired and the workability of the binder system (viscosity, solids content, etc.).

The panel may include inorganic binders. Without limitation, suitable inorganic binders include colloidal dispersions of alumina, silica, zirconia, and mixtures thereof. The inorganic binders, if present, may be used in amounts ranging from 0 to about 20 percent by weight, based upon the total weight of the composition.

The process for preparing the lightweight, fibrous thermal insulation panel includes preparing a mat or sheet comprising high temperature resistant biosoluble inorganic fibers, expanded perlite, organic and/or inorganic binder, and optionally conventional high temperature resistant inorganic fibers. The lightweight, fibrous high temperature thermal insulation panel may be produced in any way known in the art for forming sheet-like materials. For example, conventional paper-making processes, either hand laid or machine laid, may be used to prepare the sheet material. A handsheet mold, a Fourdrinier paper machine, a rotoformer paper machine or any of the known paper making machines or other devices can be employed to make the sheet material from a slurry of the components for the formation of slabs, boards or sheets of fibrous material.

Other components may also be present in the slurry such as dispersing, agents, retention aids, flocculating agents, dyes, pigments, antioxidants, surfactants, water repellents, fillers, fire retardants and the like, as long as they do not affect the fire and heat resistant properties of the composition. The components may be mixed together in any order but are mixed until a thorough blending is achieved.

For example, a flocculated slurry containing a number of components may be prepared. The slurry includes high temperature resistant biosoluble fibers, conventional high temperature resistant inorganic fibers, expanded perlite, organic binder and a carrier liquid such as water. The slurry is flocculated with a flocculating agent and drainage retention aid chemicals. The flocculated mixture or slurry may be placed onto a papermaking machine to be formed into a ply or sheet of fiber containing mat or paper. The sheet is dried by air drying or oven drying. For a more detailed description of standard papermaking techniques employed, see U.S. Pat. No. 3,458,329, the disclosure of which is incorporated herein by reference.

Alternatively, the plies or sheets may be formed by vacuum casting the slurry. According to this method, the slurry of components is wet laid onto a pervious web. A vacuum is applied to the web to extract the majority of the moisture from the slurry, thereby forming a wet sheet. The wet plies or sheets are then dried, typically in an oven. The sheet may be passed through a set of roller to compress the sheet prior to drying. The compositions can be compressed to form thin, lightweight, low density sheets that can be used to shield objects from flames or high temperatures.

Various panel thicknesses from about ⅛ inch through about 2 inches or more, and in some embodiments about 1 inch, may be formed. Panel products having basis weights ranging from about 100 grams per square meter (g/m$^2$ or "gsm") to about 5000 gsm, and in some embodiments from about 1000 gsm to about 3000 gsm, may be formed.

While the process described above is directed to making panels, it will be appreciated that formed shapes could be made from the above formulation, if desired. In this case, the basic shape may be formed during the initial operation and before entering the dryer. Such processes are well known in the art for forming shaped products.

The following examples are intended to merely further exemplify illustrative embodiments of the lightweight, fibrous high temperature thermal insulation panel and the process for preparing the panel. It should be understood that these examples are for illustration only and should not be considered as limiting the subject lightweight, fibrous high temperature thermal insulation panel, the process for preparing the lightweight, fibrous high temperature thermal insulation panel, products incorporating the lightweight, fibrous high temperature thermal insulation panel and processes for using the lightweight, fibrous high temperature thermal insulation panel.

Test Series 1

Specimens of fibrous high temperature thermal insulation panels were prepared for testing in accordance with the time temperature heating curve of the FTP Code (1998) Resolution A.754(18), using panels comprising the formulations as set forth in Table I, and produced as described below.

TABLE 1

| Example | Isofrax | Mineral Wool | E-Glass | High Density Perlite | Medium Density Perlite | Low Density Perlite | Organic Binder |
|---|---|---|---|---|---|---|---|
| Comparative Example 1 | 97.5% | | | | | | 2.5% |
| Example 2 | 57.5% | | | 40% | | | 2.5% |
| Example 3 | 37.5% | | 20% | 40% | | | 2.5% |
| Example 4 | 26.0% | 40% | | 30% | | | 4.0% |
| Example 5 | 26.0% | 40% | | | 30% | | 4.0% |
| Example 6 | 26.0% | 40% | | | | 30% | 4.0% |
| Example 7 | 26.0% | 30% | | | | 40% | 4.0% |
| Example 8 | 56.0% | | | | | 40% | 4.0% |

Isofrax biosoluble fibers are commercially available from Unifrax I LLC (Niagara Falls, N.Y.).

"High" Density Perlite having a density of about 93 kg/m$^3$ available from Harborlite Corporation (Lompoc, California).

"Medium" Density Perlite having a density of about 72 kg/m$^3$.

"Low" Density Perlite having a density of about 56 kg/m$^3$.

Mineral Wool was Fibrox 030 Mineral Wool available from Fibrox Technology, Ltd. (Thetford Mines, Quebec, Canada).

Binder was an acrylate resin.

The formulation components for low-density panels were combined, mixed, and formed into panels by hand in a laboratory caster. Low-density boards were all made to a basis weight specification of 2000 gsm. However, the subject lightweight, fibrous high temperature thermal insulation panels may have a basis weight of from about 500 gsm to about 6000 gsm. All of the panels in Test Series 1 fell into the density range of from about 4 lbs/ft$^3$ to about 10 lbs/ft$^3$ (from about 60 kg/m$^3$ to about 160 kg/m$^3$), particularly in the range of from about 4.5 lbs/ft$^3$ to about 6 lbs/ft$^3$ (from about 72 kg/m$^3$ to about 96 kg/m$^3$). In comparison, the density of the Duraboard® LD material is generally about 14-21 lbs/ft$^3$, typically about 14-18 lbs/ft$^3$.

An aqueous slurry was formed with mixing from the above components in water containing about 1% solids by weight. The slurry was then passed through a 60 mesh screen using a vacuum of 15 inches of Hg. Following the vacuum forming of a mat from the slurry, the mat was dried in a convection oven at 120° C. until substantially all of the water was removed, producing a rigid panel.

The resulting boards had a density of 4-10 lb/ft$^3$ (60-160 kg/m$^3$) and a flexural strength of about 15-20 psi. The thickness of the boards ranged from 0.5-1.2 inches (1.3-3.1 cm).

Test Protocols: Flame Testing

The thermal insulation panels were tested in accordance with the time temperature heating curve of the FTP Code FTP Code (1998) Resolution A.754(18) that is incorporated in the International Maritime Organization's ("IMO") SOLAS A60 requirements, which are incorporated herein by reference.

IMO SOLAS A60 provides in pertinent part:

SOLAS A60 certified (60 minute fire resisting division panel)—fire testing per FTP Code for A60 Bulkhead (restricted), A60 Deck Fire test criteria detailed in FTP Code Book and per IMO Resolution A.754.(18)

The Pass/Fail criteria for this test method are:

Maximum Average Cold Face Temperature:

140° C. (284° F.) over ambient (at end of time period for desired rating).

Single Cold Face Temperature:

180° C. (256° F.) over ambient (at end of time period for desired rating).

Maximum Temperature of Aluminum Structural Core:

200° C. (392° F.) over ambient (at end of 60 minutes).

The SOLAS A60 Flame Test Protocol, in pertinent part, provides:

Panel samples are fabricated and cut to 11.5"×11.5" square, ranging from 0.5 to 1.2" thick.

Test material is installed and positioned by pinning to a 13 gauge (0.089"), 12"×12" aluminum plate using four weld pins and four 1½" diameter round washers.

Samples are oriented vertically onto the furnace opening, with the insulation side facing into the furnace.

Four thermocouples are placed on the unexposed face of the aluminum plate, covered with ¼" thick insulation paper, and taped to the plate.

The furnace is heated with a natural gas burner according to the requirements of IMO Resolution A.754(18) per the standard IMO heating curve:

$$T=345\log(8t+1)+20$$

where T is the average furnace Temperature (° C.) and t is the time (minutes).

Time, furnace temperature, and unexposed face temperatures are recorded.

Data is reported as the time (in minutes) for the unexposed face temperature to reach 500° F. (260° C.) above the initial temperature.

Calculated data is based on an average of the four unexposed face thermocouple readings.

FIG. 1: Flame Test Results

Eight specimens of the fibrous thermal insulation panels described in Table 1 were tested per the method described above. FIG. 1 is a bar graph showing the time in minutes for the unexposed face temperature to reach 500° F. (260° C.) above the initial temperature for the eight panel specimens, i.e., Examples 1-8.

As demonstrated in FIG. 1, the flame tests indicate that adding expanded perlite to a fibrous panel increases its thermal resistance. Furthermore, increasing the level of perlite loading further increases the panel's performance. Decreasing the density of the expanded perlite increases the thermal resistance performance. Best performance results were obtained with panels made with high temperature resistant fiber and "Low" Density perlite having a density of about 56 kg/m$^3$.

Generally, increasing the level of biosoluble fibers while decreasing the level of mineral wool increases the panel's performance, as shown in Table 2. Isofrax® biosoluble fibers and mineral wool were combined into a series of 7 lb/ft$^3$ blankets, according to the mineral wool mass % shown in Table 2. The samples were flame tested 500° F. (260° C.) for three hours followed by a fast ramp to 2000° F. (1093° C.). Shown in Table 2 are times for the cold face to reach 250° F. (121° C.) above the ambient temperature, with time starting at the onset of the 2000° F. (1093° C.) ramp-up.

TABLE 2

| Mineral Wool Level (mass %) | Time to 250° F. Temp Increase (min) |
|---|---|
| 0% | 20 |
| 20% | 18.7 |
| 40% | 17.1 |
| 60% | 13.5 |
| 100% | <10 (material melted) |

Test Series 2

Flame Test Results

Figure 2:
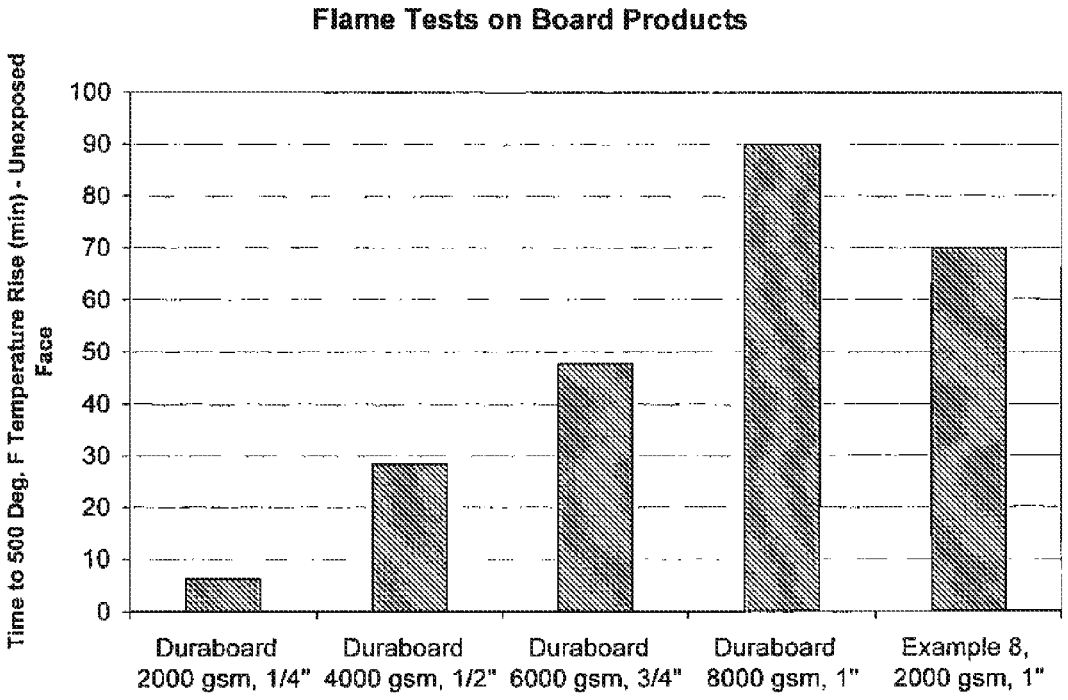
FIG. 2 is a graph depicting the results of flame tests for five specimens tested in accordance with the time temperature heating curve of the FTP Code (1998) Resolution A.754(18).

Additionally, four specimens of commercially available thermal insulation panels having standard densities were taken from production lots and cut to size for testing according to protocols mandated by International Maritime Organization pursuant to SOLAS A60 requirements. Specifically, the comparative panels comprised:

a. Fiberfrax® DURABOARD® ceramic fiber panel—2000 gsm, ¼ inch b. Fiberfrax® DURABOARD® ceramic fiber panel—4000 gsm, ½ inch c. Fiberfrax® DURABOARD® ceramic fiber panel—6000 gsm, ¾ inch d. Fiberfrax® DURABOARD® ceramic fiber panel—8000 gsm, 1 inch Flame results for these four commercial panels are shown in FIG. 2 in comparison to a subject ultra-light panel. FIG. 2 is a bar graph showing the time in minutes for the unexposed face temperature to reach 500° F. (260° C.) above the initial temperature for five panel specimens, i.e., four commercially available thermal insulation panels in various densities and thicknesses, and a 1 inch, ultra-light panel having a density of 2000 gsm (Example 8 from Test Series 1).

As demonstrated in FIG. 2, the flame test results indicate that when compared to a commercially available, standard density board product, the ultra-light panel of Example 8 (2000 gsm, 1") greatly outperformed a board of the same weight (i.e., Duraboard 2000 gsm, ¼"), and significantly outperformed a panel that was three times as heavy (i.e., Duraboard 6000 gsm, ¾").

Test Series 3

Flame Test Results

Figure 3:
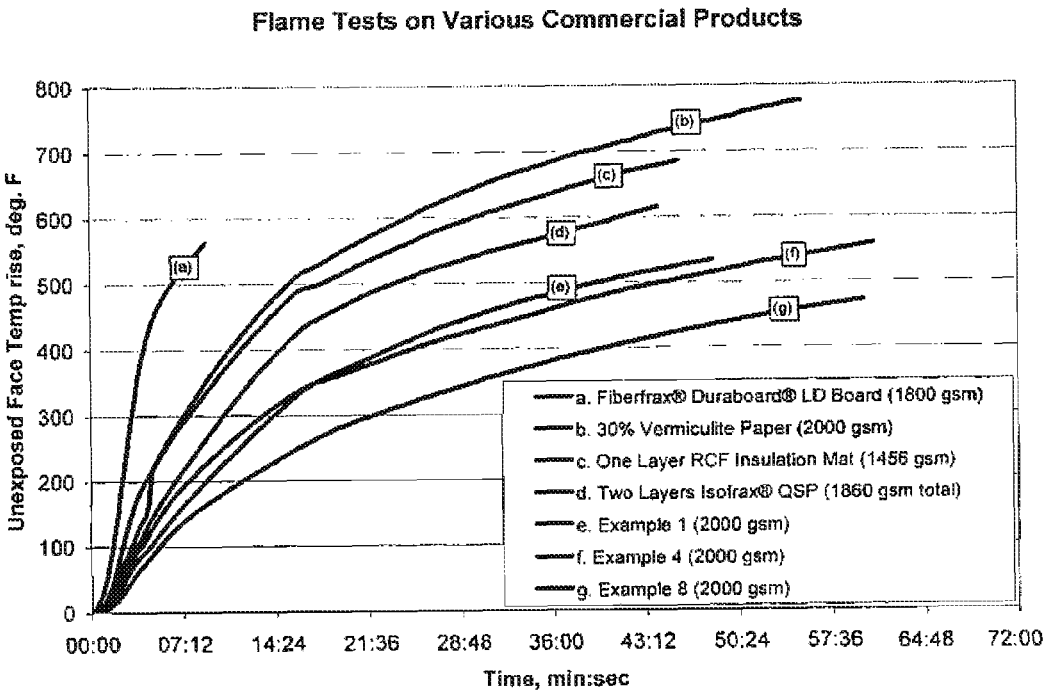
FIG. 3 is a graph depicting the flame test performance of seven specimens tested in accordance with the time temperature heating curve of the FTP Code (1998) Resolution A.754 (18).

FIG. 3 is a graph demonstrating the flame test performance of seven panels having the following compositions:

a. Fiberfrax® Duraboard® LD[1] ceramic fiber board having a basis weight of 1800 grams per square meter.

[1] Fiberfrax® Duraboard® LD is a rigid, high-temperature ceramic fiber panel comprising Fiberfrax® alumina-silica fibers and binders, available from Unifrax I LLC.

b. Panel comprising biosoluble fiber and 30% vermiculite paper, having a basis weight of 2000 grams per square meter.

c. One layer of a non-intumescent insulation mat containing conventional high temperature inorganic fiber including RCF and having a basis weight of 1456 grams per square meter.

d. Two layers of Isofrax QSP[2] paper containing biosoluble fibers, non-respirable inorganic fibers, and organic and inorganic binder having a basis weight of 1860 grams per square meter.

[2] Isofrax® QSP Insulation is a thin, flexible, nonwoven insulation material comprising Isofrax® 1260° C. fibers available from Unifrax I LLC.

e. Paper of Ex. 1 from Test Series 1 containing no perlite and having a basis weight of 2000 grams per square meter.

f. Panel of Example 4 from Test Series 1, having a basis weight of 2000 grams per square meter.

g. Panel of Example 8 from Test Series 1, having a basis weight of 2000 grams per square meter and a density of about 4.5 lbs./ft$^2$.

The respective papers and panels (boards) were pinned to an aluminum plate and flame tested as described in Test Series 1.

Taken together, this data demonstrates that lightweight, fibrous thermal insulation panel comprising high temperature resistant biosoluble fibers, expanded perlite, high temperature resistant inorganic fibers and no greater than 5% organic binder, exhibited increased fire resistance as compared to other, commercially available materials. The lightweight, fibrous thermal insulation panels are substantially non-combustible and pass International Maritime Organization SOLAS A60 fire rating tests or B0 or N30 fire resistance tests.

The ISO 1182 test apparatus consists of a refractory tube furnace, 75 mm in diameter and 150 mm in height. The tube is open at the top and bottom, and air flows through the furnace due to natural convection. A conical transition piece is provided at the bottom of the furnace to stabilize the airflow. The air temperature inside the furnace is stabilized to 750° C. prior to testing. A cylindrical test specimen, 45 mm in diameter and 50 mm in height, is inserted into the furnace at the start of the test. Sheathed thermocouples are used to measure the temperature of the furnace air ($T_f$), specimen surface ($T_s$), and specimen interior ($T_s$). The test is conducted for a fixed duration of 30 min, in accordance with the IMO interpretation of the FTP Code (Annex 3 to IMP FP 44/18 dated May 2000). The duration of flaming is recorded during the test, and specimen mass loss is determined based on weight measurements before testing and after removal from the furnace and cool-down in a desiccator. ISO 1182:1990 requires that a series of five tests be conducted for each sample.

A material is classified as "Non-combustible" according to Part 1 of the FTP Code, if, for a series of five tests, the following criteria are met:

1. The average maximum furnace temperature rise, $\Delta T_f$, (with the final temperature as the reference) does not exceed 30° C.;
2. The average maximum surface temperature rise, $\Delta T_s$, (with the final temperature as the reference) does not exceed 30° C.;
3. The average duration of sustained flaming does not exceed 10 s; and
4. The average mass loss (with respect to the original specimen mass) does not exceed 50 percent.

Table 3 shows results of tests run as described above for 5 samples of Example 4 of Test Series 1. All five samples passed the criteria for non-combustibility.

TABLE 3

| Run No. | Mass Loss (%) | Ignition Duration (s) | Average Furnace Temperature Rise (° C.) | Average Surface Temperature Rise (° C.) |
|---|---|---|---|---|
| 1 | 4 | 0 | 4 | 4 |
| 2 | 4 | 0 | 4 | 3 |
| 3 | 4 | 0 | 3 | 1 |
| 4 | 4 | 0 | 6 | 6 |
| 5 | 4 | 0 | 5 | 1 |
| Average | 4 | 0 | 4 | 3 |

While the lightweight, fibrous thermal insulation panel and process for preparing the same have been described in connection with various illustrative embodiments, it will be understood that the embodiments described herein are merely exemplary, and that one skilled in the art may make variations and modifications without departing from the spirit and scope of the invention. All such variations and modifications are intended to be included within the scope of the claims herein. Further, all embodiments disclosed are not necessarily in the alternative, as various embodiments may be combined to provide the desired result. Therefore, the lightweight, fibrous high temperature thermal insulation panel and process should not be limited to any single embodiment, but rather construed in breadth and scope in accordance with the recitation of the appended claims.

We claim:

1. A lightweight, fibrous high temperature thermal insulation panel comprising high temperature resistant biosoluble inorganic fibers, expanded perlite, binder, and optionally conventional high temperature resistant inorganic fibers; wherein the panel is rigid; the panel density is from about 60 kg/m$^3$ to about 160 kg/m$^3$; and the panel comprises from 0% to about 70% by weight mineral wool, from about 10% to about 80% by weight expanded perlite, from about 15% to about 90% by weight magnesium silicate fiber, and from greater than 0% to about 50% by weight acrylic latex binder by weight.

2. The lightweight, fibrous high temperature thermal insulation panel of claim 1, wherein the panel comprises from 0% to about 70% by weight mineral wool, from about 10% to about 80% by weight expanded perlite, from about 15% to about 90% by weight magnesium silicate fiber, and from greater than 0% to about 6% by weight acrylic latex binder by weight.

3. The lightweight, fibrous high temperature thermal insulation panel of claim 2, comprising, by weight:

mineral wool in an amount of from 0% to about 40%;

expanded perlite in an amount of from about 20% to about 60%;

magnesium silicate fiber in an amount of from about 30% to about 70%;

acrylic latex binder in an amount of from about 2% about 4%; and polyvinyl alcohol in an amount of from 0% to about 1%.

4. The lightweight, fibrous high temperature thermal insulation panel of claim 1, wherein the conventional high temperature resistant inorganic fibers comprise at least one of refractory ceramic fibers, mineral wool fibers, leached glass silica fibers, fiberglass, glass fibers or mixtures thereof.

5. The lightweight, fibrous high temperature thermal insulation panel of claim 4, wherein the ceramic fibers comprise alumina-silica fibers.

6. The lightweight, fibrous high temperature thermal insulation panel of claim 5, wherein the alumina-silica fibers comprise the fiberization product of from about 45 to about 75 weight percent alumina and from about 25 to about 55 weight percent silica.

7. The lightweight, fibrous high temperature thermal insulation panel of claim 4, wherein the mineral wool fibers comprise at least one of rock wool fibers, slag wool fibers or glass wool fibers.

8. A lightweight, fibrous high temperature thermal insulation panel comprising high temperature resistant biosoluble inorganic fibers, expanded perlite, binder, and optionally conventional high temperature resistant inorganic fibers; wherein the panel is rigid; the panel density is from about 60 kg/m$^3$ to about 160 kg/m$^3$; and wherein the high temperature resistant biosoluble fibers comprise at least one of alkaline earth silicate fibers, calcia-aluminate fibers, potassia-calcia-aluminate fibers, potassia-alumina-silicate fibers, or sodia-alumina-silicate fibers.

9. The lightweight, fibrous high temperature thermal insulation panel of claim 8, wherein the alkaline earth silicate fibers comprise at least one of calcium-magnesia-silicate fibers or magnesium-silicate fibers.

10. The lightweight, fibrous high temperature thermal insulation panel of claim 8, wherein the binder comprises an organic binder comprising from about 1% to about 10% acrylic latex by weight.

11. The lightweight, fibrous high temperature thermal insulation panel of claim 10, wherein the organic binder comprises from about 1% to about 5% acrylic latex by weight.

12. The lightweight, fibrous high temperature thermal insulation panel of claim 8, wherein the binder comprises up to 5% organic binder fibers by weight.

13. The lightweight, fibrous high temperature thermal insulation panel of claim 1, wherein the expanded perlite has a density in the range of from about 30 kg/m$^3$ to about 150 kg/m$^3$.

14. The lightweight, fibrous high temperature thermal insulation panel of claim 1, wherein the expanded perlite has a density in the range of from about 55 kg/m$^3$ to about 146 kg/m$^3$.

15. The lightweight, fibrous high temperature thermal insulation panel of claim 1, produced by a wet forming process.

16. The lightweight, fibrous high temperature thermal insulation panel of claim 15, wherein the wet forming process is a paper-making process.

17. The lightweight, fibrous high temperature thermal insulation panel of claim 15, wherein the wet forming process is a vacuum forming process.

18. The lightweight, fibrous high temperature thermal insulation panel of claim 1 having a density of from about 72 kg/m$^3$ to about 96 kg/m$^3$.

19. The lightweight, fibrous high temperature thermal insulation panel of claim 1 having a basis weight of from about 500 gsm to about 6,000 gsm.

20. A method for preparing a lightweight, fibrous high temperature thermal insulation panel comprising:

(a) providing an aqueous slurry comprising
  from about 15% to about 90% high temperature resistant biosoluble inorganic fibers, wherein the high temperature resistant biosoluble fibers comprise at least one of alkaline earth silicate fibers, calcia-aluminate fibers, potassia-calcia-aluminate fibers, potassia-alumina-silicate fibers, or sodia-alumina-silicate fibers,
  from about 10% to about 80% expanded perlite,
  binder comprising at least one of from 0% to about 50% organic binder or from 0% to about 20% inorganic binder by weight, and optionally from 0% to about 70% conventional high temperature resistant fibers;
(b) forming the lightweight, fibrous thermal insulation panel by depositing the said aqueous slurry onto a substrate;
(c) partially dewatering the slurry on the substrate to form a fibrous layer;
(d) drying the fibrous layer to a moisture content of no greater than about 5% by weight;

wherein the dried fibrous thermal insulation panel is rigid; and wherein the panel density is from about 60 kg/m$^3$ to about 160 kg/m$^3$.

21. The method of claim 20 wherein the binder is at least one of from greater than 0% to about 6% organic binder or from greater than 0% to about 20% inorganic binder by weight, wherein the insulation panel is non-combustible.

22. The method of claim 20 wherein the aqueous slurry further comprises at least one of dispersing agents, retention aids, flocculating agents, dyes, pigments, antioxidants, surfactants, water repellents, fillers or fire retardants.

23. The method of claim 20 further comprising applying a vacuum pressure differential to the slurry on the substrate to remove water from the slurry.

24. A method for preparing a lightweight, fibrous high temperature thermal insulation panel comprising providing an aqueous slurry comprising high temperature resistant biosoluble inorganic fibers, expanded perlite, organic and/or inorganic binder, and optionally conventional high temperature resistant inorganic fibers, and depositing the aqueous slurry onto a substrate, partially dewatering the slurry on the substrate to form a fibrous layer, and drying the fibrous layer to a moisture content of no greater than about 0.5% by weight, wherein the dried fibrous thermal insulation panel is rigid; wherein the panel density is from about 60 kg/m$^3$ to about 160 kg/m$^3$; and wherein the high temperature resistant biosoluble fibers comprise at least one of alkaline earth silicate fibers, calcia-aluminate fibers, notassia-calcia-aluminate fibers, potassia-alumina-silicate fibers, or sodia-alumina-silicate fibers.

25. The lightweight, fibrous high temperature thermal insulation panel of claim 8 wherein the panel comprises from about 15% to about 90% high temperature resistant biosoluble inorganic fibers, from about 10% to about 80% perlite, from greater than 0% to about 50% organic binder, and optionally from 0% to about 70% conventional high temperature resistant inorganic fibers by weight.

26. The lightweight, fibrous high temperature thermal insulation panel of claim 8 wherein the binder comprises from 0% to about 6% organic binder and/or from 0% to about 20% inorganic binder by weight, wherein the insulation panel is non-combustible.

27. The lightweight, fibrous high temperature thermal insulation panel of claim 8, wherein the conventional high temperature resistant inorganic fibers comprise at least one of refractory ceramic fibers, mineral wool fibers, leached glass silica fibers, fiberglass, glass fibers or mixtures thereof.

28. The lightweight, fibrous high temperature thermal insulation panel of claim 27, wherein the ceramic fibers comprise alumina-silica fibers.

29. The lightweight, fibrous high temperature thermal insulation panel of claim 28, wherein the alumina-silica fibers comprise the fiberization product of from about 45 to about 75 weight percent alumina and from about 25 to about 55 weight percent silica.

30. The lightweight, fibrous high temperature thermal insulation panel of claim 8, wherein the expanded perlite has a density in the range of from about 30 $kg/m^3$ to about 150 $kg/m^3$.

31. The lightweight, fibrous high temperature thermal insulation panel of claim 8, wherein the expanded perlite has a density in the range of from about 55 $kg/m^3$ to about 146 $kg/m^3$.

32. The lightweight, fibrous high temperature thermal insulation panel of claim 8, produced by a wet forming process.

33. The lightweight, fibrous high temperature thermal insulation panel of claim 32, wherein the wet forming process is a paper-making process.

34. The lightweight, fibrous high temperature thermal insulation panel of claim 32, wherein the wet forming process is a vacuum forming process.

35. The lightweight, fibrous high temperature thermal insulation panel of claim 8 having a density of from about 72 $kg/m^3$ to about 96 $kg/m^3$.

36. The lightweight, fibrous high temperature thermal insulation panel of claim 8 having a basis weight of from about 500 gsm to about 6,000 gsm.

* * * * *